US008927841B2

(12) United States Patent
Hallerberg

(10) Patent No.: US 8,927,841 B2
(45) Date of Patent: Jan. 6, 2015

(54) DRUM STAND STABILIZING ASSEMBLY

(71) Applicant: Dale A. Hallerberg, Lake Barrington, IL (US)

(72) Inventor: Dale A. Hallerberg, Lake Barrington, IL (US)

( * ) Notice: Subject to any disclaimer, the term of this patent is extended or adjusted under 35 U.S.C. 154(b) by 92 days.

(21) Appl. No.: 13/852,075

(22) Filed: Mar. 28, 2013

(65) Prior Publication Data

US 2013/0298748 A1 Nov. 14, 2013

Related U.S. Application Data

(60) Provisional application No. 61/688,078, filed on May 8, 2012.

(51) Int. Cl.
*G10D 13/02* (2006.01)

(52) U.S. Cl.
CPC ..... *G10D 13/026* (2013.01)
USPC ..... 84/411 R

(58) Field of Classification Search
USPC ..... 84/411 R, 421
See application file for complete search history.

(56) References Cited

U.S. PATENT DOCUMENTS

| | | | | |
|---|---|---|---|---|
| 624,662 | A | 5/1899 | Leedy | |
| 2,433,594 | A | 12/1947 | Calo | |
| 5,645,253 | A | 7/1997 | Hoshino | |
| 2011/0030531 | A1 | 2/2011 | Nakata et al. | |
| 2012/0103164 | A1 | 5/2012 | Wang | |
| 2012/0318118 | A1* | 12/2012 | Miyajima | 84/421 |

* cited by examiner

*Primary Examiner* — Kimberly Lockett
(74) *Attorney, Agent, or Firm* — Meroni & Meroni, P.C.; Charles F. Meroni, Jr.; Christopher J. Scott

(57) ABSTRACT

A drum stand stabilizing assembly, generally intended for marching percussion instruments such as snare drums. The invention uses a lateral support to hold the weight of the instrument in multiple locations, a post or posts to stabilize the instrument in the proper position, and a mating receiver mounted to the instrument to allow for assembly of the complete support structure. The assembly provides for a stable support structure and maintains the instrument in the proper orientation for practice or performance. The assembly provides for fast and simple mounting of the instrument.

16 Claims, 8 Drawing Sheets

DRUM STAND STABILIZING ASSEMBLY

PRIOR HISTORY

This non-provisional U.S. Patent Application claims the benefit of U.S. Provisional Patent Application No. 61/688,078 filed in the United States Patent and Trademark Office on 8 May 2012, the specifications of which are hereby incorporated by reference thereto.

BACKGROUND OF THE INVENTION

1. Field of the Invention

This invention relates to new and useful improvements in support stands for drums and other musical instruments. More particularly, the present invention relates to a support stand which holds a snare drum or single tenor, for example a marching snare drum.

2. Brief Description of the Prior Art

Referencing FIG. 2 of the patent illustrations appended to these specifications, the reader will see that an exemplary prior art stand for musical instruments, especially for percussion instruments, typically shows the use of a tripod type stand with three or more supports which support the bottom edge of the drum in order to hold the drum in a position which allows the performer to play the instrument with the drumheads in a quasi-horizontal orientation. The supports are adjustable and normally include multiple wing nuts or other tightening methods to hold them in place. Certain other prior art drum stands are briefly described hereinafter.

U.S. Pat. No. 624,662 ('662 Patent), which issued to Leedy, for example, discloses a Drum Stand. The '662 Patent describes a drum stand comprising a head piece having three projections radiating from the center of the top plane thereof, a pair of arms pivoted upon the head piece and extending radially over two of said projections, an arm rigidly secured to the head piece and extending over the other one of said projections, a turned-up lug at the free end of each of said arms, a rib to support each of said pivoted arms laterally at the side opposite said rigid arm, a clamping device at the underside of said head piece, and a supporting stand connected to said clamping device. The Leedy stand appears to be suitable for supporting a single drum.

U.S. Pat. No. 2,433,594 ('594 Patent), which issued to Calo, generally discloses a folding tripod drum stand with a lateral support under the drum which is center supported. More particularly, the '594 Patent describes a drum stand comprising a flat base of extended dimensions, an adjustable telescoping standard rising centrally from the base, a drum-supporting frame, and a ball and socket connection between the standard and the drum-supporting frame to thereby provide a support for the drum frame and in which the support elements are axially aligned and extend normal to the base plane.

The ball and socket members of such connection are carried respectively by the standard and the drum-supporting frame with the ball carried by the drum frame and having its center included within such axial alignment. The ball member has an equatorial roughened zone with the drum frame extending from a polar zone of the ball. The socket member has an open top to permit lateral swing of the drum frame with a limited range, said connection including an adjusting nut cooperative with the socket member to secure the ball member in adjusted position relative to the socket and to release the ball from the socket, the relation of ball and socket being such that co-operation between the equatorial zone of the ball and the socket will be present in all of the adjusted positions of the drum frame.

The drum frame includes an arm secured to and extending from a polar axis of the ball in a direction normal to the equatorial zone. The arm carries a laterally extending element the opposite free ends of which extend angularly to the direction of length of the element and in substantial parallelism to the direction of length of the said arm, said ends each carrying means for removably securing the drum.

U.S. Pat. No. 5,645,253 ('253 Patent) which issued to Hoshino, discloses a Universal Support for Drums. The '253 Patent describes a universal support structure wherein the angular adjustment provided by the universal support for an object supported thereby remains fixed even though the object, such as a drum, has been removed from the universal support. The universal support is capable of holding a support rod relative to a support stand having an attachment member. The universal support includes a receiving member, with a rod press and a support stand press each attached to the receiving member.

The receiving member and the rod press each has a concave surface adapted to accommodate the rod support sandwiched between the contoured surfaces of the receiving member and the rod press. In addition, the receiving member and the support stand press each has a concave surface adapted to accommodate the attachment member of the support stand sandwiched between the concave surface of the receiving member and the support stand press. Thus, the universal support is capable of accommodating the attachment member of the support stand independently of the rod support.

While the above patents and many subsequent patents of the prior art disclose various instrument stands generally, and drum stands particularly, none of the prior art discloses a drum stand utilizing a post which mates to a receiver on the drum together with a lateral support which holds the weight of the instrument in multiple locations to allow for fast, simple, and stable placement of the instrument on the stand. The prior art thus perceives a need for such a drum stand construction as summarized in more detail hereinafter.

SUMMARY OF THE INVENTION

Various prior inventions have been disclosed that provide support stands for musical instruments such as percussion instruments, snare, and single-tenor drums, but none of the listed inventions provide the claims of this invention. The ideal invention would provide instrument support that is extremely stable under the use and abuse expected during heavy practice and performance. It would support the drum and maintain the proper orientation so that vibration and movement are eliminated or minimized. It would be of a design that allows very quick mounting and dismounting of the instrument. It would use few parts to simplify the use, reduce lost parts, and cut down on manufacturing costs. It would require no further adjustment or tightening once installed. It would firmly attach to the instrument in an unobtrusive location. It would be robust, yet low in weight. The proposed invention provides these features.

One of the objects of this invention is to provide instrument support that is extremely stable. The Hoshino '253 Patent, for example, discloses a single post instrument support with one arm which has the tendency to sway, bounce, and vibrate. The current invention improves on this by providing a lateral support which supports the bottom edge of the drum in two places, typically the back of the drum and the front of the drum. These supports are cushioned by resilient material such as hard rubber. The vertical riser underneath this horizontal support is located directly below the center-of-gravity of the drum which provides the optimal location for stability. The receiver is firmly attached to the drum, and the fit between the receiver and the post is snug. These elements of the invention cooperate to provide stability.

Another object of this invention is to maintain alignment of the instrument in a preferred orientation for practice or performances. This is attained by the mating shape of the post and receiver. In the preferred embodiment this mating shape is square, which provides the benefits of simplicity, low cost, and non-rotation. Other non-round shapes for the post are possible, including rectangular, triangular, "T"-shaped, or two round posts in combination.

Another object of this invention is to allow very quick mounting and dismounting of the instrument to the stand. This is attained by the post of the invention which is easy to place into the mating receiver that is attached to the drum. By tightly controlling the tolerances of this mating the invention provides for very quick mounting and dismounting of the instrument to the stand.

Another object of this invention is to reduce the parts needed for the instrument stand. This is attained by the invention needing few adjustable parts or tightening bolts such as wing nuts.

Another object of this invention is to provide various receiver designs which mate with the various drum designs currently in the marketplace. This is attained by the invention having five receivers described, which can be used as needed for various drums.

Various objects, features, aspects, and advantages of the present invention will become more apparent from the following detailed description of preferred embodiments of the invention, along with the accompanying drawings in which like numerals represent like components.

BRIEF DESCRIPTION OF THE DRAWINGS

FIG. 1(*a*) is an enlarged exploded top perspective view of the interface or receiver unit shown in exploded relation relative to a cylindrical tension rod-like member and fastening hardware for attaching the first drum-to-support receiver unit to the drum.

FIG. 3(*b*) is a second fragmentary bottom perspective view of a drum supported by the support assembly and the first drum-to-support interface or receiver unit according to the present invention showing the elements rotated about the drum axis to a first position as relatively compared to the components shown in FIG. 3(*a*).

FIG. 3(*c*) is a side elevational view of a drum supported by the support assembly and the first drum-to-support interface or receiver unit according to the present invention showing the elements rotated about the drum axis to a second position as relatively compared to the components shown in FIG. 3(*a*).

PARTS LIST

Support Assembly 10
- Post 13
- Lateral 12
- Riser 11
- Riser Top 14
- Post End 15
- Post Axis 101
- Sleeve Axis 102

Receiver Unit 20
- Sleeve 21
- Mounting structure 22
- Flange 23
- Mounting Holes 24
- Cylinder 25
- Coupler Unit 26
- Tension Rod 27
- Hex Footing 28
- Radius of Curvature 29
- Welds 90

Stand base 30
- Upright Member 31

Drum 40
- Drum Shell 41
- Drum Bottom Edge 42
- Cylinder 45

Receiver Unit 50 for Mounting to Two Vertical Cylinders
- Sleeve 51
- Plate 52
- Clamp 53
- Hardware 54

Receiver Unit 60 for Mounting to One Vertical Cylinder
- Sleeve 61
- Tube Mount 62
- Hardware 63

Receiver Unit 70 for Mounting to Tension Rods
- Sleeve 71
- Plate 72
- Tension Rod "L" Bracket 73
- Apertures 74

Receiver Unit 80 for Mounting to Drum Shell
- Sleeve 81
- Hardware 82

Supports 100 from Prior Art

DETAILED DESCRIPTION OF THE PREFERRED EMBODIMENT

Figure 1:
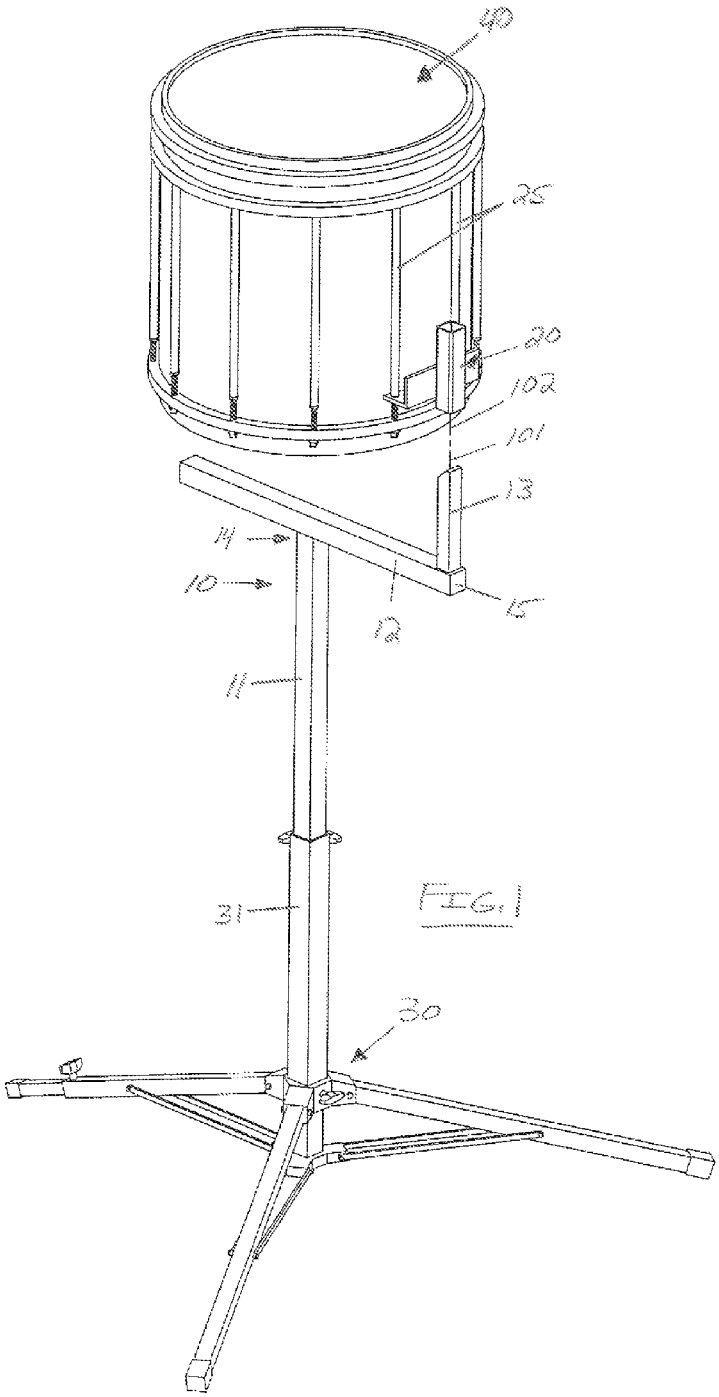
FIG. 1 is an exploded top perspective view of a drum stand stabilizing assembly according to the present invention showing a drum stand juxtaposed underneath a drum with a first drum-to-support interface or receiver unit being attached to the drum.
Figure 1A:
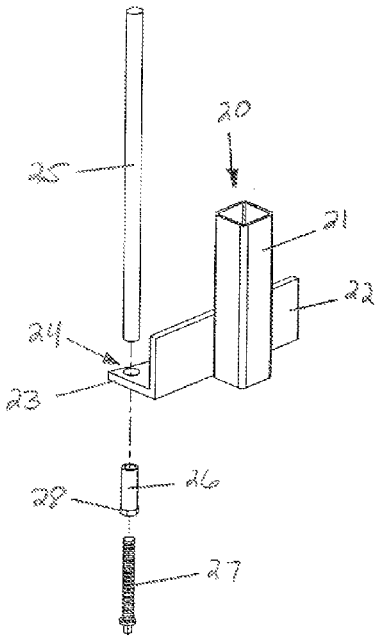

Referring now the drawings with more specificity, FIG. 1 attempts to depict a preferred drum stand stabilizing assembly according to the present invention with a drum 40 mounted thereto. The drum or percussion instrument stand stabilizing assembly according to the present invention may be said to comprise, in combination, a stand base 30; a support assembly 10; and a drum-to-support receiver unit or interface construction 20.

Generally referencing FIG. 1, the support assembly 10 is held or supported by the stand base 30. In this regard, the stand base 30 is preferably of a tripod type construction having an upwardly oriented member 31 matable with the riser element 11 of the support assembly 10. The support assembly 10 mates with the preferred drum-to-support receiver unit 20 as well as with alternative receiver units 50, 60, 70, and 80. The receiver unit 20 is preferably attached to the percussion instrument or drum 40 via certain fastening means.

Referencing FIG. 1(*a*), for example, it will be seen that the receiver unit 20 comprises mounting holes as at 24. The mounting holes 24 comprise an inner diameter sufficient to abut the cylindrical sleeve unit as at 25. According to state of the art drum construction, a tension rod 27 may be received inside the coupler unit 26, which tightens to the cylindrical sleeve unit 25.

The outer diameter of the coupler unit 26 is sized for receipt within the inner diameter of the cylindrical sleeve unit 25. The tension rod 27 threadably fastens to the coupler unit 26 and the hex footing 28 of the coupler unit 26 provides a seat upon which the flange 23 is supported when the coupler unit 26 is inserted into the cylindrical sleeve unit 25. The mounting holes 24 are formed in the flange 23 so as to receive or fasten to adjacent cylindrical sleeve units 25. Further, the flange 23 preferably comprises a radius of curvature (as at 29) that substantially matches that of the drum 40 at the drum shell 41.

The riser 11 of the support assembly 10 is preferably oriented vertically and is adjustably and telescopically receivable in the upwardly extending (female) upright member 31 of the stand base 30. The lateral element 12 is connected to, and supported by the riser element 11 so as to support the front and rear bottom edges 42 of the drum 40. A post 13 extends upwardly or vertically from a post end of the lateral element 11 and has transverse dimensions that are sized and shaped to cooperate with the transverse dimensions of the sleeve 21 for penetration thereof or matable engagement therewith.

In the preferred embodiment the post, lateral, and riser elements 13, 12, and 11 comprise rectangular (or square) transverse cross-sections essentially for preventing rotation about the axes thereof, although other non-circular cross-sectional shapes are possible. The post axis 101 and the sleeve axis 102 are generally depicted in coaxial alignment in FIG. 1. It will be understood from a consideration of FIG. 1 that rotation about the axes 101 and 102 is prevented by the transverse construction of the sleeve 21 mated with the post 13.

Figure 2:
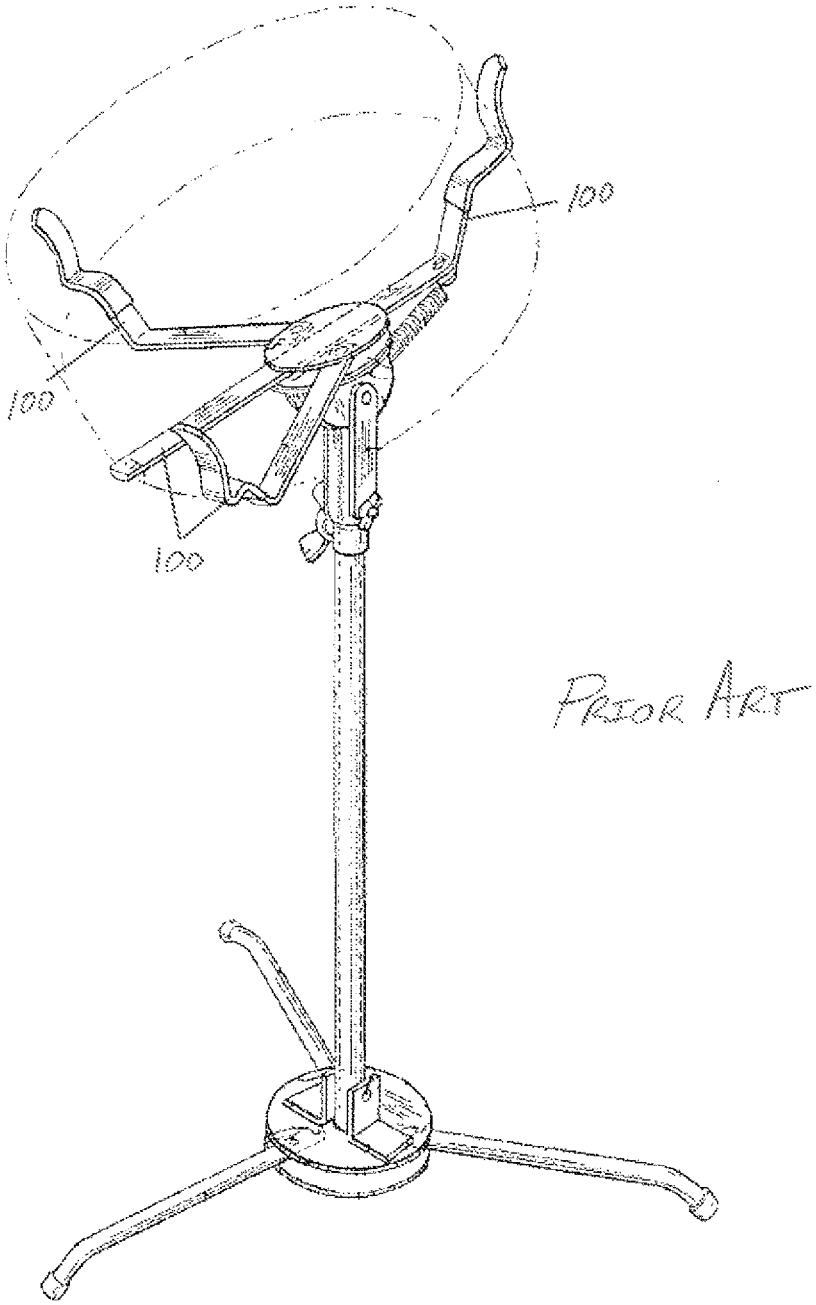
FIG. 2 is a top perspective view of a Prior Art drum stand assembly shown supporting a phantom drum.
Figure 3A:
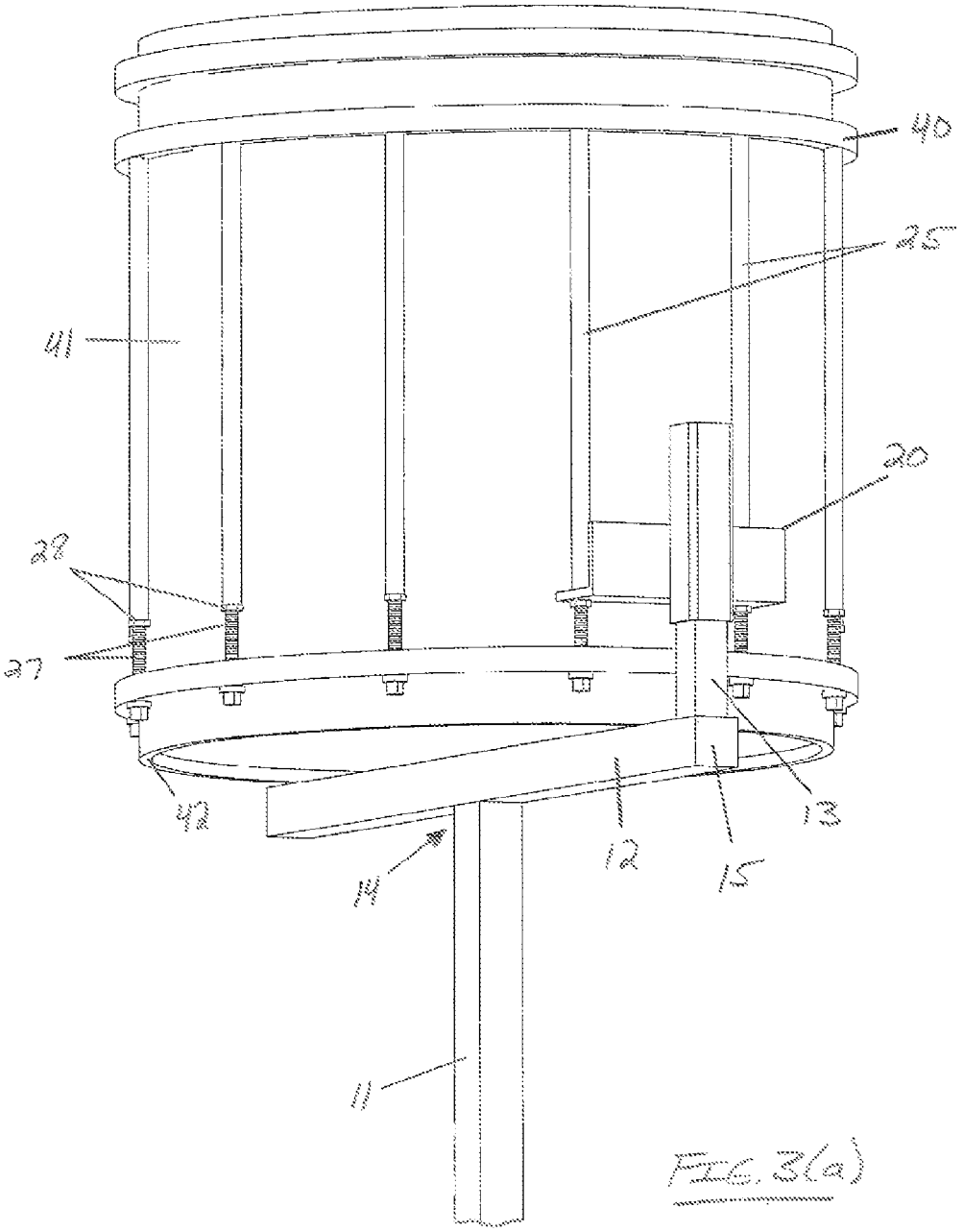
FIG. 3(*a*) is a first fragmentary bottom perspective view of a drum supported by the support assembly and first drum-to-support interface or receiver unit according to the present invention.
Figure 3B:
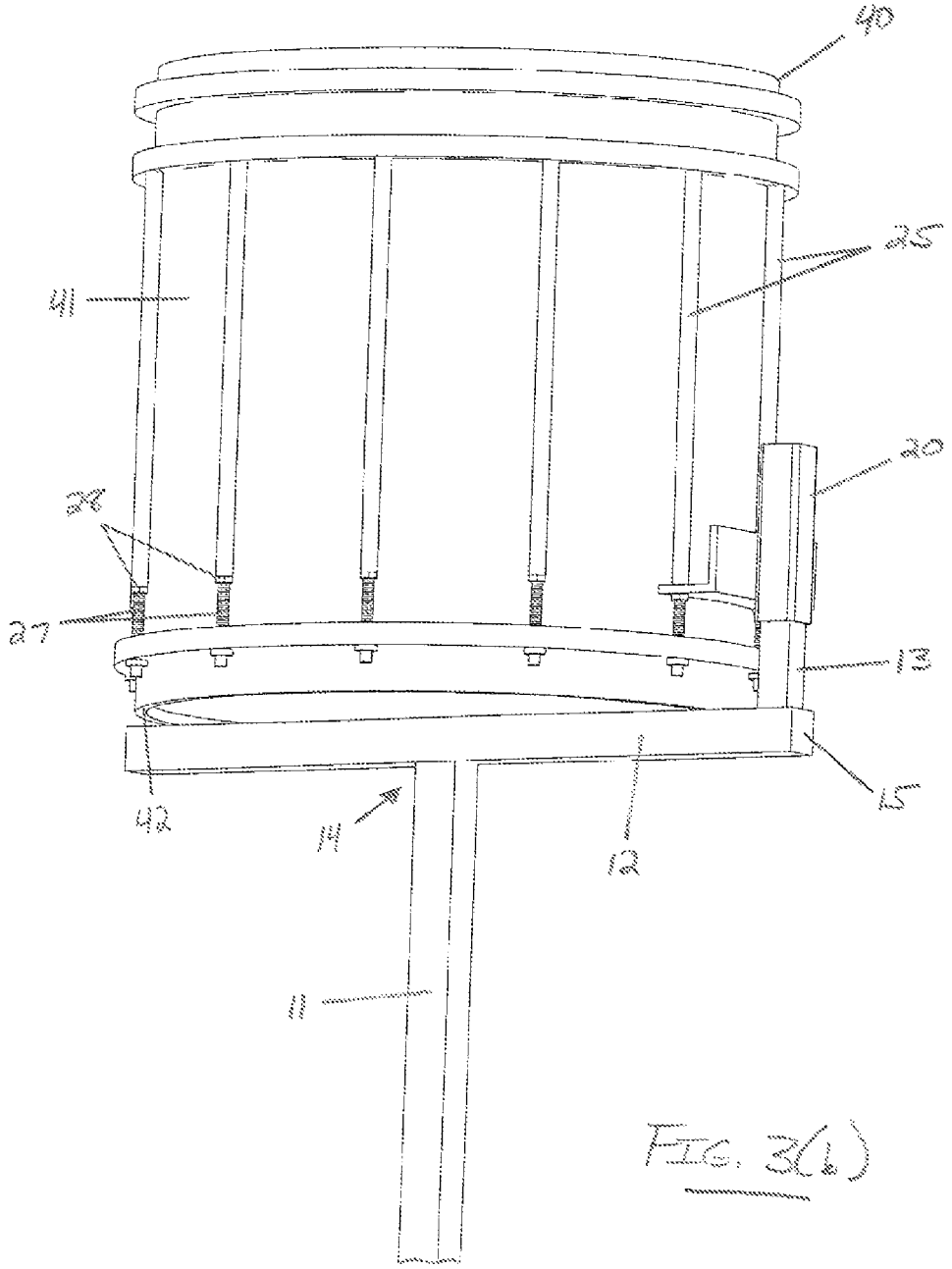
Figure 3A:
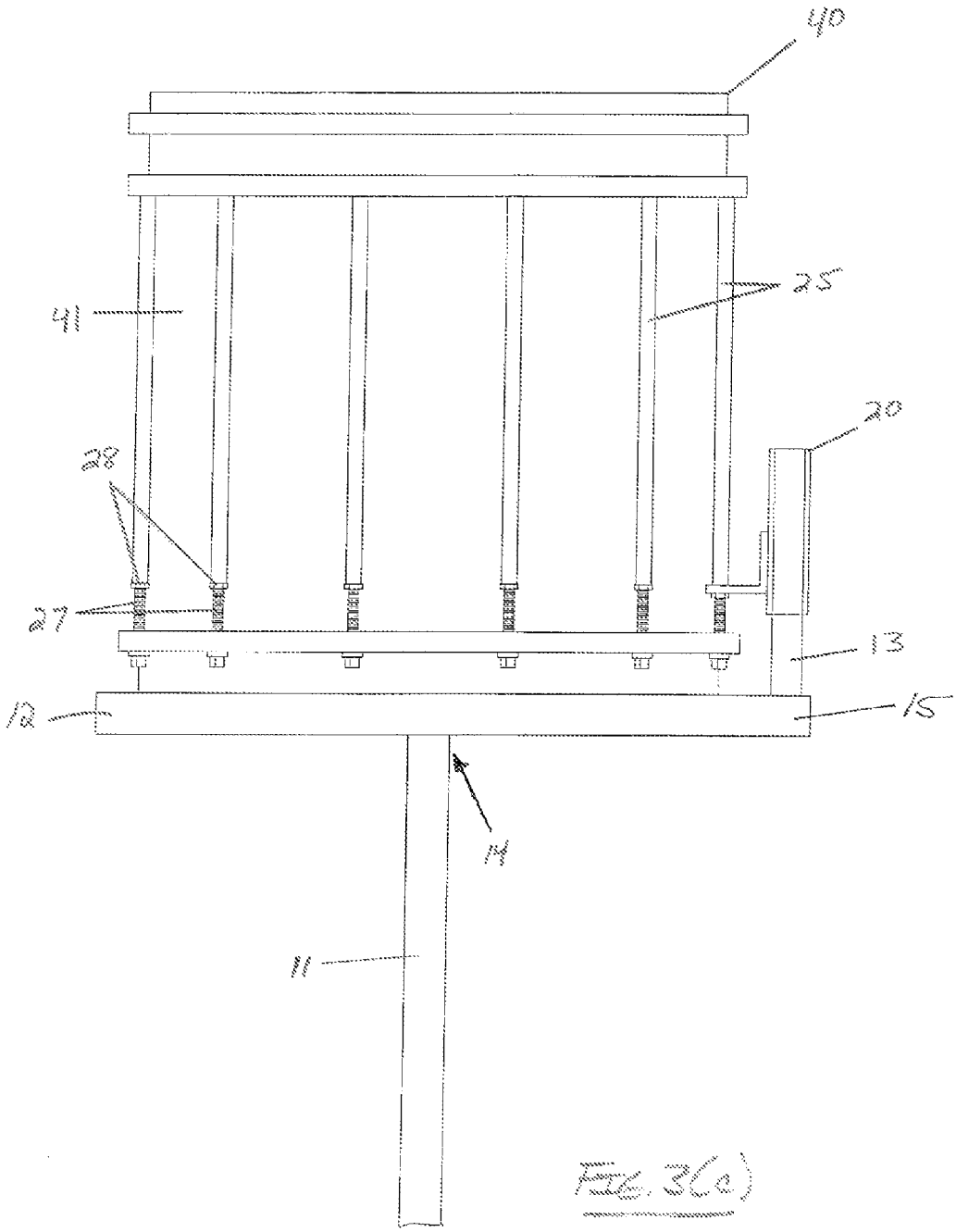

The reader is invited to compare the teachings generally shown in FIGS. 1, 1(*a*), and 3(*a*) to 3(*c*) to those prior art teachings shown in FIG. 2. The reader will note from a comparative inspection of the noted figures that the exemplary prior art drum stand shown in FIG. 2 is intended for a single drum. Prior art drum stands of the type shown in FIG. 2 typically show the use of a tripod type stand with three or more supports as at 100, which support the bottom edge of the drum in order to hold the drum in a position which allows the performer to play the instrument with the drumheads in a quasi-horizontal orientation. The supports 100 are adjustable and normally include multiple wing nuts or other cumbersome tightening methods to hold them in place.

The present instrument stand stabilizing assembly is believed superior to prior art drum stands of the type shown in FIG. 2 insofar as the interface or receiver unit 20 is more robustly fastened to the drum 40, and is mated with the support assembly 10 and stand base 30 such that the combined weight of the drum 40 and receiver unit 20 seat the drum 40 upon the lateral element 12, and the anti-rotation characteristics of the post 13 and sleeve 21 maintain the drum in a static position as supported by the lateral element 12. Percussion instruments are necessarily force-absorbing instruments, and thus are prone to dislodgements or displacements not adequately addressed by the prior art drum stand shown in FIG. 2.

Figure 4:
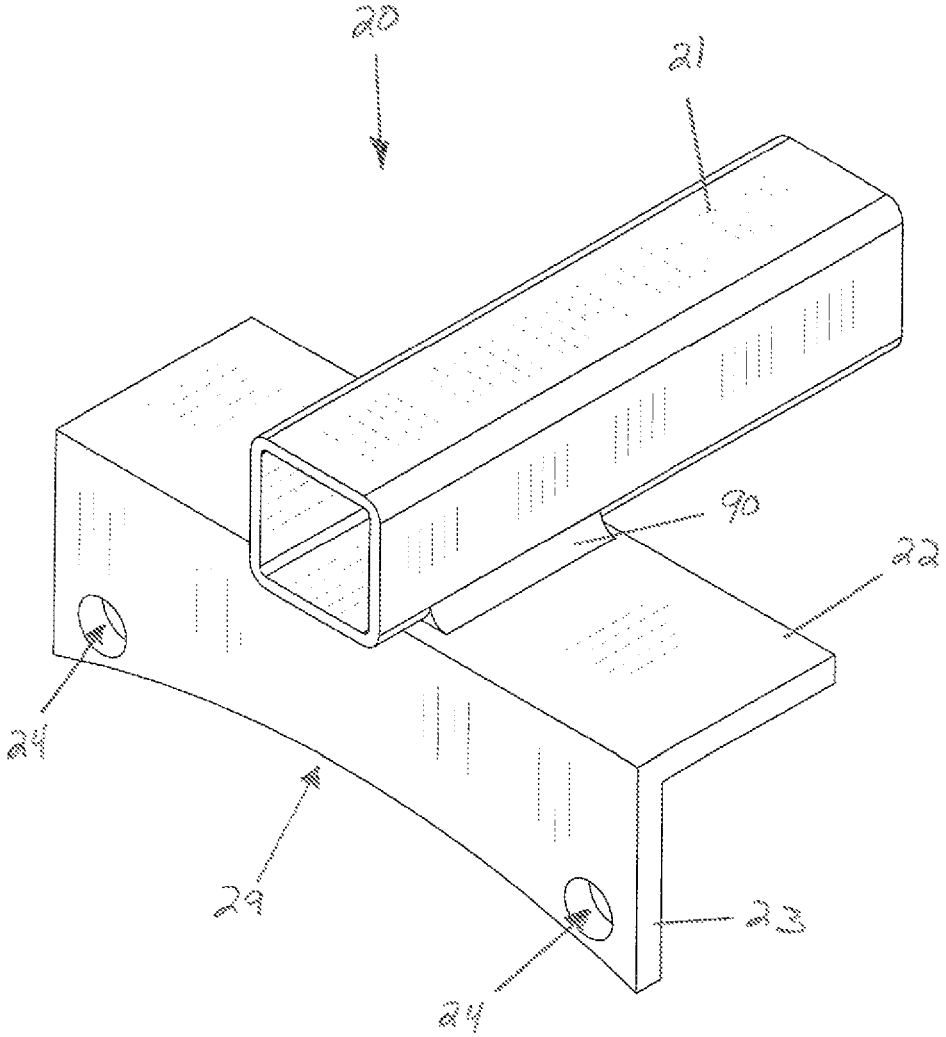
FIG. 4 is a rear bottom perspective view of the first drum-to-support interface or receiver unit according to the present invention.

Referring to FIG. 4, the reader is shown an enlarged bottom front perspective of the drum-to-support interface or receiver unit 20 of the drum stand stabilizing assembly according to the present invention. The preferred embodiment of the sleeve 21 is shown as comprising a square transverse cross-section, which sleeve 21 mates with the post 13. The sleeve 21 is attached to the mounting structure 22, for example, by welds as at 90. In the preferred embodiment the mounting structure 22 is stabilized by a flange 23, and the receiver unit 20 is attached to the drum 40 by use of mounting holes or apertures 24.

Figure 5:
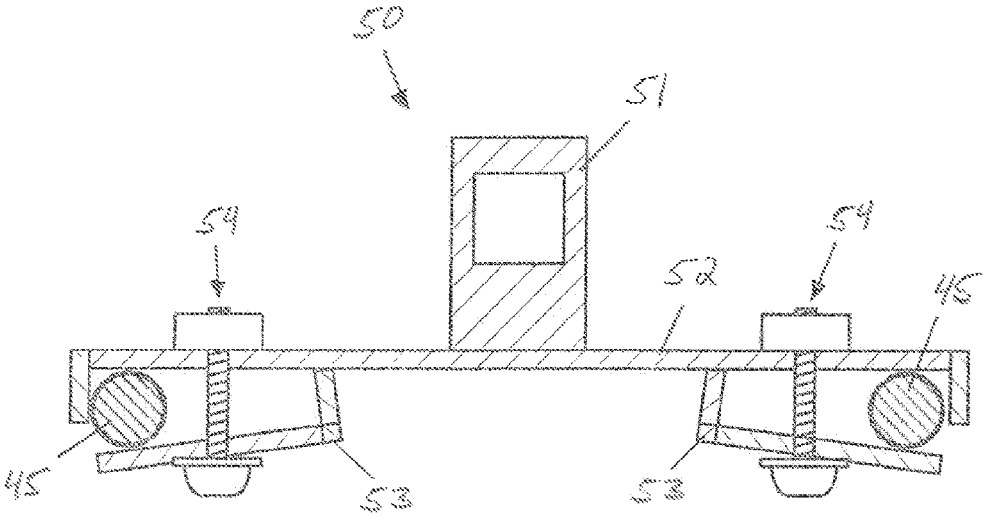
FIG. 5 is a cross-sectional view of a second drum-to-support receiver unit according to the present invention for mounting to two vertical cylinders or tension rods.

Various commercially available drums will require variations in mounting methods and variations in receiver unit design, as discussed in more detail hereinafter. Referring to FIG. 5, for example, there is shown an alternative drum-to-support interface or receiver unit 50 according to the drum stand stabilizing assembly of the present invention. The riser element 11 supports the lateral element 12, which lateral element 12 supports the front and rear bottom edges 42 of the drum 40 as before. The post element 13 is oriented vertically to fit into the sleeve 51. The sleeve 51 is attached to the plate 52 which has return bends which fit to the outside of two vertical cylinders 45 on the drum 40. The clamps 53 and certain fastening means as exemplified by bolt-nut assemblies 54 fasten the receiver unit 50 tightly to the two vertical cylinders 45 via the clamps 53.

Figure 6:
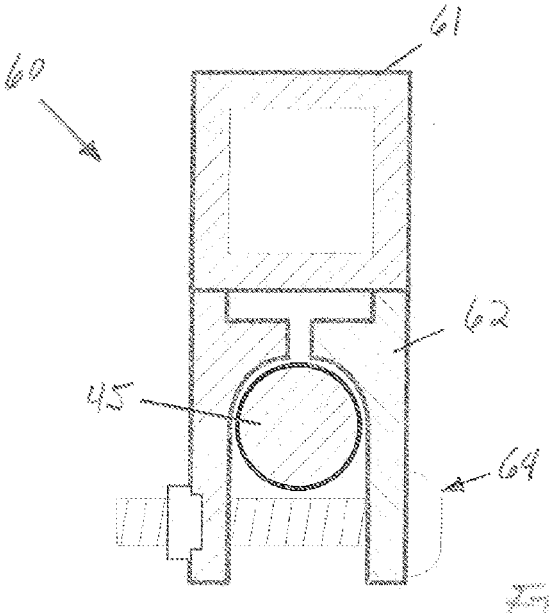
FIG. 6 is a cross-sectional view of a third drum-to-support receiver unit according to the present invention for mounting to one vertical cylinder or tension rod.

Referring to FIG. 6, there is shown an alternative drum-to-support interface or receiver unit 60 for mounting to one vertical cylinder as at 45. The sleeve 61 of the receiver unit 60 is held to the cylinder 45 by a tube mount 62 and certain fastening means as exemplified by a bolt assembly 64 which clamps the cylinder 45 tightly.

Figure 7:
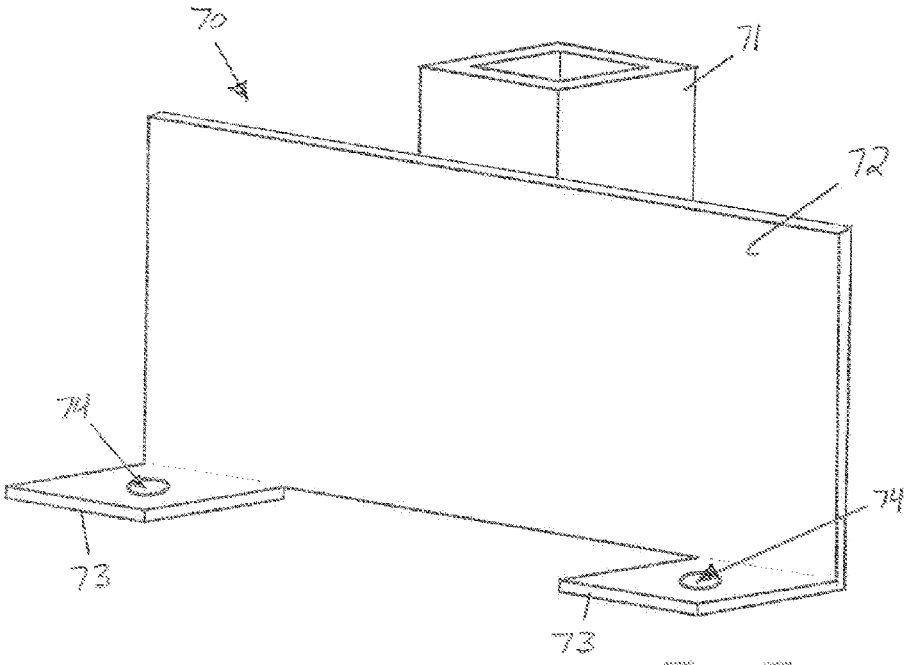
FIG. 7 is a top rear isometric or perspective view of the first drum-to-support receiver unit according to the present invention for mounting to two tension rods.

Referring to FIG. 7, there is shown an alternative drum-to-support interface or receiver unit 70 for mounting to tension rods. The sleeve 71 is fixed to the plate 72. Conceivably, tension rod "L" or angle brackets 73 may be preferably formed as part of the plate 72 or may be formed as separate parts attached to the plate 72. Rod-receiving apertures 74 are preferably formed in the brackets 73.

Figure 8:
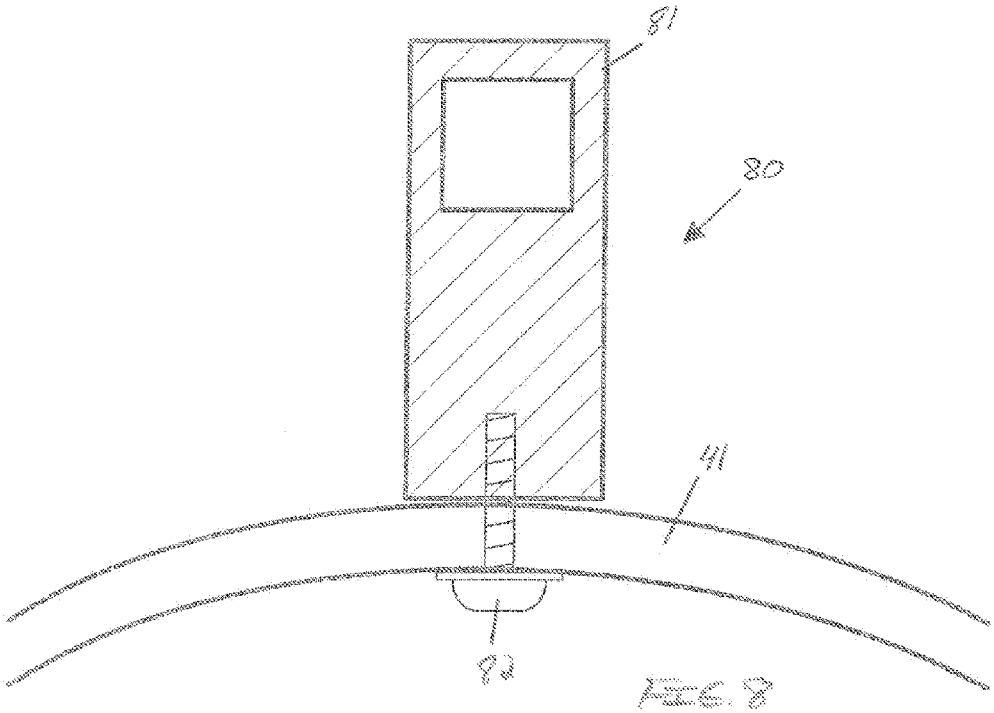
FIG. 8 is a cross-sectional view of a fourth drum-to-support receiver unit according to the present invention for mounting directly to a drum shell.

Finally, referring to FIG. 8, there is shown an alternative drum-to-sleeve mounting arrangement or receiver construction 80 for mounting (directly) to a drum shell 41 of a drum 40. In the receiver construction 80, the sleeve 81 is attached via certain fastening means as exemplified by a screw or bolt fastener 82 through holes drilled in the drum shell 41.

While the foregoing specifications set forth much specificity, the same should not be construed as setting forth limits to the invention but rather as setting forth certain preferred embodiments and features. For example, as prefaced hereinabove, it is contemplated that the present invention essentially provides a drum or (percussion) instrument stand stabilizing assembly. The instrument stand stabilizing assembly according to the present invention is believed to essentially comprise a stand base, a riser element, a lateral element, a post element, and a post-receiving sleeve element.

The riser element 11 is supportable by the stand base 30 and comprises a riser top as at 14. The lateral element 12 comprises an overall lateral length and a post end as at 15. The lateral element 12 is attached at a point intermediate its lateral length to the riser top 14. The lateral length is sufficient to support a drum 40 in at least two places (e.g. forward and rearward bottom edge points) along a bottom edge 42 of the drum 40.

The post element 13 is mounted to the lateral element 12, and preferably has a non-circular cross section (e.g. square). The post-receiving sleeve 21 is mountable to the drum 40 and also preferably comprises a non-circular sleeve cross section (e.g. square). The post 13 is matable with the post-receiving sleeve 21. The non-circular cross sections of the post 13 and sleeve 21 essentially function to prevent rotation of the sleeve 21 relative to the post 13 about the post and sleeve axes 101 and 102.

Although not specifically illustrated, the instrument stand stabilizing assembly according to the present invention could conceivably be practiced by incorporating two posts 13 at opposite ends of the lateral element 12 along with two receiver units 20, mounted to opposite sides of the drum 40. Further, the lateral element could conceivably comprise a series of radiating lateral elements with a first number of post(s) mounted at the ends thereof, and a corresponding number of receiver units attached to the drum 40.

The illustrations provided in this specification are intended as basic or exemplary. Accordingly, the inventive assembly could conceivably comprise at least one post 13 mounted to a post end of the lateral element 12, and at least one post-receiving sleeve 21 mountable to the drum 40. Each post-receiving sleeve 21 may then be matable with each post 13 within the spirit of the invention. Given two or more post-sleeve matings, the preference for non-circular transverse cross-sections of the post and sleeve constructions is tempered.

As variations in drum design exist, the present invention further contemplates a number of alternatives for fastening a drum to a sleeve type construction. In this regard, the present invention further contemplates a drum stand stabilizing assembly comprising a receiver assembly, which receiver assembly may comprise: a mounting plate, a flange extending from the mounting plate, and mounting apertures formed in the flange, which apertures are sized and shaped to cooperably mate with a commercially available drum.

Alternatively, the receiver assembly may comprise a mounting plate and at least one clamp. Each clamp may be cooperable with the mounting plate and may be formed to clamp the mounting plate to one or more vertical cylinders on a commercially available drum. Further, the receiver assembly may comprise a mounting plate and L-shaped brackets extending from the mounting plate, which L-shaped brackets may be formed to mount to tension rods on a commercially available drum. Still further, the receiver assembly may be fastenable directly to the shell 41 of a drum 40.

Thus, specific embodiments and applications for a drum stand stabilizing assembly have been disclosed. It should be apparent, however, to those skilled in the art that many more modifications besides those described are possible without departing from the inventive concepts herein. The inventive subject matter, therefore, is not to be restricted except in the spirit of the appended claims.

I claim:

1. A drum stand stabilizing assembly, comprising:

a riser, the riser being supportable by a stand base and comprising a riser top;

a lateral, the lateral comprising a lateral length and a post end, the lateral being attached to the riser top at a point intermediate along the lateral length, said lateral length being sufficient to support a drum in at least two places along a bottom edge of the drum;

at least one post mounted to the post end, the at least one post having a non-circular post cross section;

at least one post-receiving sleeve, the at least one post-receiving sleeve being mountable to the drum and comprising a non-circular sleeve cross section, the at least one post being matable with the at least one post-receiving sleeve, the non-circular post and sleeve cross sections for preventing rotation of the sleeve relative to the post; and a receiver assembly, the receiver assembly comprising a mounting plate, a flange extending from the mounting plate, and mounting apertures formed in the flange, the mounting apertures being sized and shaped to cooperably mate with a commercially available drum.

2. The drum stand stabilizing assembly of claim 1 comprising:

at least one clamp, the at least one clamp being cooperable with the mounting plate and being formed to clamp the mounting plate to two vertical cylinders on a commercially available drum.

3. The drum stand stabilizing assembly of claim 1 comprising:

a mounting structure, the mounting structure being formed to clamp the mounting structure to a vertical cylinder on a commercially available drum.

4. The drum stand stabilizing assembly of claim 1 comprising:

L shaped brackets extending from the mounting plate, the L-shaped brackets being formed to mount to tension rods on a commercially available drum.

5. The drum stand stabilizing assembly of claim 1 wherein the receiver assembly is attachable to a shell, the shell being from a commercially available drum.

6. A percussion instrument stand stabilizing assembly, comprising:

a riser, the riser being supportable by a stand base and comprising a riser top;

a lateral, the lateral comprising a lateral length and a post end, the lateral being attached to the riser top at a point intermediate along the lateral length, said lateral length being sufficient to support a percussion instrument in at least two places along a bottom edge of the percussion instrument;

a post mounted to the post end, the post having a non-circular post cross section;

a sleeve, the sleeve being mountable to the percussion instrument and comprising a non-circular sleeve cross section, the post being non-rotatively matable with the sleeve; and a receiver assembly, the receiver assembly comprising a mounting plate, a flange extending from the mounting plate, and mounting apertures formed in the flange, the mounting apertures being sized and shaped to cooperate with a commercially available percussion instrument.

7. The percussion instrument stand stabilizing assembly of claim 6 comprising at least one post mounted to the post end of the lateral and at least one sleeve mountable to the percussion instrument, the at least one sleeve being non-rotatively matable with the at least one post.

8. The percussion instrument stand stabilizing assembly of claim 6 comprising:

at least one clamp, the at least one clamp being formed to clamp the mounting plate to two vertical cylinders on a commercially available percussion instrument.

9. The percussion instrument stand stabilizing assembly of claim 6 comprising:

a mounting structure, the mounting structure being formed to clamp the mounting to a cylinder structure on a commercially available percussion instruments.

10. The percussion instrument stand stabilizing assembly of claim 6 comprising:

at least one L-shaped bracket extending from the mounting plate, the at least one L-shaped bracket being formed to mount to a rod-like structure on a commercially available percussion instrument.

11. The percussion instrument stand stabilizing assembly of claim 6 wherein the receiver assembly is attachable to a shell, the shell being from a commercially available percussion instrument.

12. An instrument stand stabilizing assembly, comprising:

a lateral element, the lateral comprising a lateral length and a post end, said lateral length being sufficient to support an instrument in at least two places along a bottom edge of the instrument;

a post, the post having a post axis and being mounted to the post end;

a sleeve, the sleeve having a sleeve axis and being mountable to the instrument and matable with the sleeve, the post and sleeve axes being coaxial when in mated engagement; and a receiver assembly, the receiver assembly comprising a mounting plate, a flange extending from the mounting plate, and mounting apertures formed in the flange, the mounting apertures being sized and shaped to cooperate with a commercially available instrument.

13. The instrument stand stabilizing assembly of claim 12 wherein the post and sleeve comprise non-circular cross-sections for preventing sleeve rotation about the post and sleeve axes.

14. The instrument stand stabilizing assembly of claim 12 comprising:

at least one clamp, the at least one clamp being formed to clamp the mounting plate to at least one cylinder on a commercially available instrument.

15. The instrument stand stabilizing assembly of claim 12 comprising:

a bracket extending from the mounting plate, the bracket being formed to mount to a rod-like structure on a commercially available instrument.

16. The instrument stand stabilizing assembly of claim 12 wherein the receiver assembly is attachable to a shell, the shell being from a commercially available instrument.

* * * * *